US005079982A

United States Patent [19]

Antonissen

[11] Patent Number: 5,079,982

[45] Date of Patent: Jan. 14, 1992

[54] SLICING MACHINE FEEDING DEVICE

[75] Inventor: Peter Antonissen, Norfolk, England

[73] Assignee: Thurne Engineering Co., Ltd., England

[21] Appl. No.: 536,572

[22] PCT Filed: Jan. 13, 1989

[86] PCT No.: PCT/GB89/00029

§ 371 Date: Jul. 11, 1990

§ 102(e) Date: Jul. 11, 1990

[87] PCT Pub. No.: WO89/06588

PCT Pub. Date: Jul. 27, 1989

[30] Foreign Application Priority Data

Jan. 15, 1988 [GB] United Kingdom ..... 8800920

[51] Int. Cl.[5] ..... B26D 7/06

[52] U.S. Cl. ..... 83/422; 83/206; 83/282; 83/409; 83/356; 198/626.5

[58] Field of Search ..... 83/206, 422, 282, 356, 83/409; 198/345.1, 345.2, 345.3, 626.1, 626.5, 626.6

[56] References Cited

U.S. PATENT DOCUMENTS

| | | | |
|---|---|---|---|
| 3,162,226 | 12/1964 | Toby et al. | 83/206 |
| 3,910,143 | 10/1975 | Wallace et al. | 83/422 |
| 4,719,831 | 1/1988 | Smithers | 83/422 |

*Primary Examiner*—Hien H. Phan
*Assistant Examiner*—Raymond D. Woods
*Attorney, Agent, or Firm*—Sughrue, Mion, Zinn Macpeak & Seas

[57] ABSTRACT

A slicing machine includes a rotatable blade (1) and a feeding device (4, 5) for feeding blocks of product (46) towards the blade (1). The feeding device comprises opposed driven endless track assemblies (4, 5) having their adjacent faces arranged to be driven in the same direction. One of the opposed track assemblies (4) is formed by a number of separate side-by-side endless tracks (6, 7, 8, 9) which are pivotally connected to a common support (20). The number of separate tracks (6, 7, 8, 9) have a ganged drive and pneumatic rams (22) which, in use, urge the downstream ends of the tracks independently towards the block of product (46) so that the separate tracks pivot independently and hold a block of product (46) the thickness of which is not uniform in the transverse direction. The support (20) supports the upstream ends of the endless tracks (6, 7, 8, 9) and is slideably mounted for movement in a direction parallel to the plane of the blade (1). A pneumatic actuator (21) is provided to urge the support (20) towards the other endless track assembly (5) to accommodate differences in thickness between subsequent blocks of product (46).

7 Claims, 7 Drawing Sheets

SLICING MACHINE FEEDING DEVICE

BACKGROUND OF THE INVENTION

Slicing machines are used for slicing blocks of meat, meat products and other food products such as cheese. Typically they include a rotating blade having a spiral cutting edge, or a rotating blade having a circular cutting edge which is mounted for orbital motion so that upon each rotation of the spiral cutting edge blade or each orbit of the circular cutting edge blade its cutting edge moves across the face of a block of product to cut a slice from it. The block of product is fed stepwise and moves when the cutting edge is out of contact with it or is fed forwards continuously so that the cutting edge follows a generally helical path through the block. Conventionally the block of product rests on a stationary bed and is driven forwards towards the blade by a pusher having a gripper or suction pad which engages the rear face of the block of product. In this case a spring loaded paddle usually bears downwards on the block of product to steady it towards its downstream end.

It is also known to replace the stationary bed and pusher by a pair of opposed driven conveyors having their adjacent faces arranged to be driven in the same direction. An example of a slicing machine with such a feeding device is shown in U.S. Pat. No. 3,162,226 which has the pair of opposed conveyors mounted above and below the block of product. The spacing between the opposed conveyors is manually adjustable and the upper conveyor is mounted at about its mid-point by a spring loaded connection which can accommodate small variations in the height of blocks of product. Such arrangements are particualrly useful because they enable blocks of product to be fed successively so that they can be sliced with substantially no interruption between them and they avoid the need for interrupting the slicing whilst the pusher is withdrawn and a further block is located on the stationary bed.

One problem however with this type of arrangement is that although the downstream end of the conveyors approach the plane of cut of the blade because of the curvature of the end rollers of the conveyor the last 30 to 40 mms of each block is substantially unsupported. As this portion is cut by the blade the blade tends to grab the block and pull it too far downstream so cutting slices that are thicker than required. This problem is exaggerated still further in the arrangement shown in U.S. Pat. No. 3,162,226 because of the way in which the upper conveyor is connected at about its mid-point by a spring loaded connection. This results in the end portions of each block being inadequately held. In an attempt to overcome this U.S. Pat. No. 3,162,226 includes an additional plate which engages the cut face of the block of product and supports the cut face in position as the blade moves towards it. This additional plate oscillates back and forth with the cutting edge of the blade.

It is known that the quality of slices cut by a slicing machine is very dependent upon the support and control of the movement of the block of product and particularly the support and control of the movement of the end portion of the block of product. Many other attempts have been made to support the product as firmly as possible and as close as possible to the plane of cut of the blade. Meat and similar food products are flexible and somewhat fragile. If they are not held firmly enough the block tends to be pulled as the blade is cutting a slice from its face as has already been mentioned. This problem is particularly bad for blocks having non-parallel sides. Meat such as sides of bacon are a natural product and even after they have been subjected to a pressing operation their sides are not flat and certainly not parallel. Molded products such as molded meat products and cheese often have sides which are flat but are not parallel to one another since the mold includes a taper to enable the product to be de-molded. Thus even if opposite side faces of such molded products are flat they are often not parallel.

A significant attempt to overcome all of these problems is disclosed in GB-A-2133279 which discloses a slicing machine including a rotatable blade and a feeding device for feeding blocks of product towards the blade, the feeding device being divided in a direction transverse to its feed direction into a number of separate elements pivotally connected to a common support and having a ganged drive and biasing means which, in use, urge the separate elements adjacent the blade independently towards the block of product so that the separate elements pivot independently and hold a block of product the thickness of which is not uniform in the transverse direction. In this example the separate elements are formed by rollers which engage only the downstream end of the block of product which include backwardly facing teeth to resist the forwards pull of the knife-blade. The rollers are supported by a pivoted parallelogram-type linkage but, nevertheless, as the rollers pivot and move towards the block of product they tend to move further away from the plane of cut of the blade and so support the product less effectively.

This British specification is a further improvement over an earlier attempt to hold securely the last portion of a block of product which is described in U.S. Pat. No. 4,329,900. In this earlier specification only a single roller is pivotally mounted and arranged to bear against the downstream end of a block of product. Since the arrangement shown in this earlier specification only uses a simple pivot rather than a parallelogram linkage the roller tends to move even further away from the plane of cut of the blade as it pivots towards the block of product.

The feeding device disclosed in these two specifications undoubtedly supports the end portions of each block of product more firmly and as close as possible to the plane of cut of the blade than the conventional arrangement such as that disclosed in U.S. Pat. No. 3,162,226. However, they both tend only to engage the product to both feed it and prevent the forward pull from the blade along a single line of contact which, particularly with delicate products leads to damage of the product.

SUMMARY OF THE INVENTION

According to this invention a slicing machine such as disclosed in GB-A-2133279, is characterised in that the feeding device comprises opposed driven endless track assemblies having their adjacent faces arranged to be driven in the same direction, one of the opposed track assemblies being formed by a number of separate side-by-side endless tracks, in that the support supports the upstream end of the endless tracks and is slideably mounted for movement in a direction parallel to the plane of the blade, and in that a pneumatic actuator is provided to urge the support towards the other endless track assembly.

By replacing the toothed roller assembly described in GB-A-2133279 with opposed track assemblies a very much better control of the feed of the block of product is obtained. The tracks spread the gripping load over a very much larger area which prevents a feeding device damaging the product and as a result of it being positively fed on both sides by the opposed tracks the feed of the block of product is also spread over a greater area of product. However, more importantly, because the support for the number of separate tracks is slideably mounted and biased towards the other of the opposed tracks the downstream ends of the separate tracks move strictly parallel to the plane of the blade. Thus, as the support moves to accommodate different thicknesses of block the downstream end of the separate tracks remain at a substantially constant distance from the plane of cut of the blade and do not move away from the blade as the thickness of the block decreases as does the arrangement shown in GB-A-2133279 and U.S. Pat. No. 4,329,900. It is only the movement of the downstream ends of the pivoted tracks resulting from differences in thickness of the block of product in the transverse direction which results in any pivoting movement of the separate tracks and this is very small compared to the differences in thickness of different blocks. The pneumatic actuator provides a controlled and constant pressure on the support and hence on the separate tracks irrespective of its displacement.

Preferably the tracks have the smallest practical diameter at their downstream end but, even then with their downstream end close to the plane of the blade the final portion of the block equivalent to the radius of the downstream end of the endless tracks is unsupported. Preferably therefore elongate guide fingers are intercallated between the independent tracks and are arranged to engage and support the product immediately adjacent the blade and so support the product right up to its downstream end. The fingers may be independently biased downwards onto the surface of the block of product but preferably they are connected to a support for an adjacent track and move towards and away from the opposite track assembly with that track. Typically the support fingers extend to within 1 or 2 mm of the plane of cut of the blade.

Preferably the separate tracks include a support arranged towards their downstream end to bear against the tracks and urge them towards the other track assembly. The support may be spring loaded to encourage the tracks to conform to the surface of the block or product over a substantial proportion of its length.

The tracks may be formed by a continuous belt having a plain or ribbed surface but preferably they are formed by sprocket chain having transverse plates attached to adjacent links. The transverse plates may include spikes or other projections arranged positively to engage the block of product but we have found that plates having a stepped surface are particularly effective in supporting and holding the product firmly without damaging it.

The opposite track assembly may also be formed by a number of parallel side-by-side tracks arranged independently but, it is normally sufficient for the other track assembly to be formed by a single conveying track assembly. Most products include at least one face which is substantially planar and thus, by placing this substantially planar face onto the other track assembly the track assembly formed by a number of separate tracks conforms to an opposite side of the block of product whether this is planar but non-parallel or whether it is of irregular shape.

BRIEF DESCRIPTION OF THE DRAWINGS

A particular example of a feeding device in accordance with this invention will now be described with reference to the accompanying drawings in which.

DETAILED DESCRIPTION OF THE PREFERRED EMBODIMENT

Figure 1:
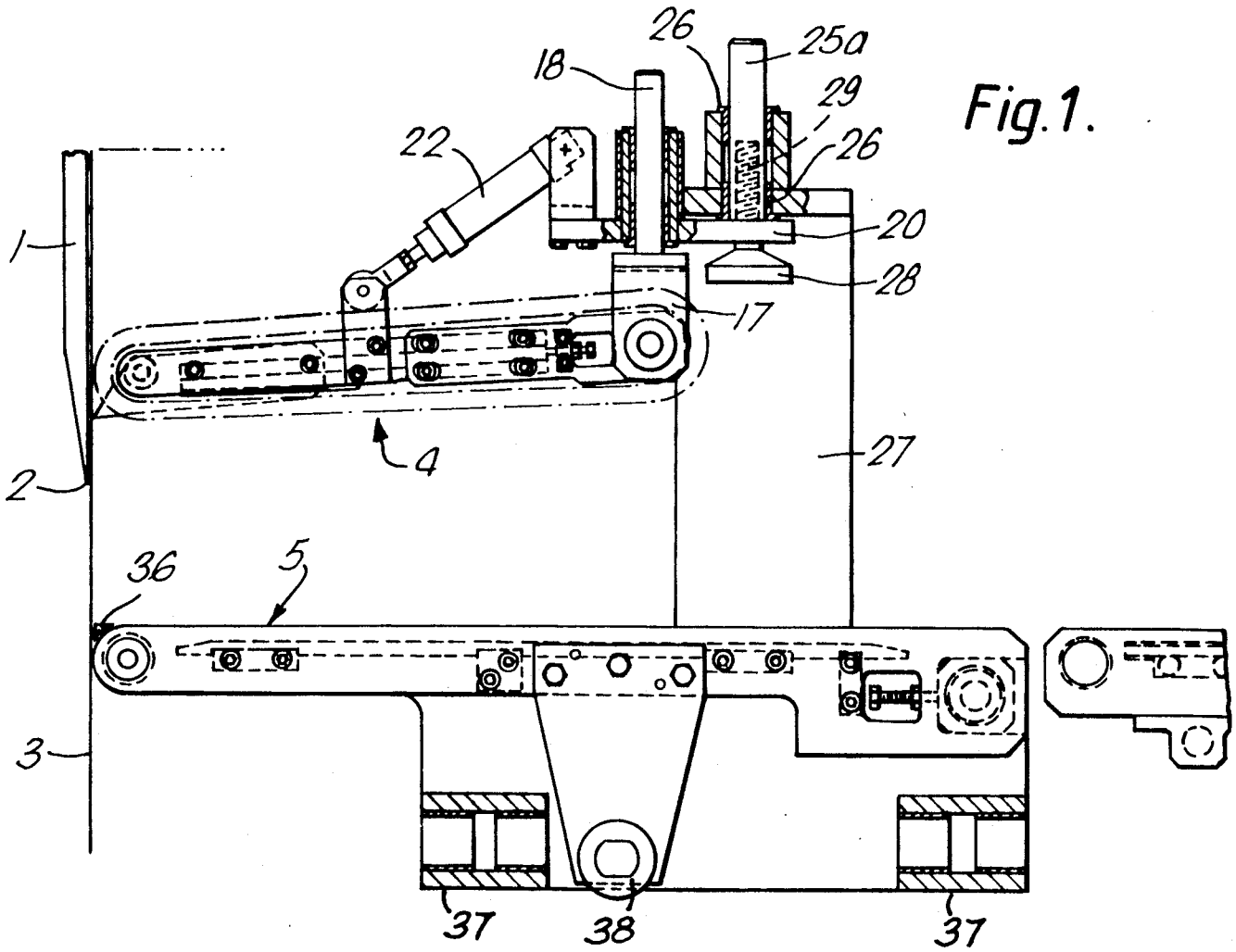
FIG. 1 is a simplified cut away side elevation of part of a slicing machine.
Figure 2:
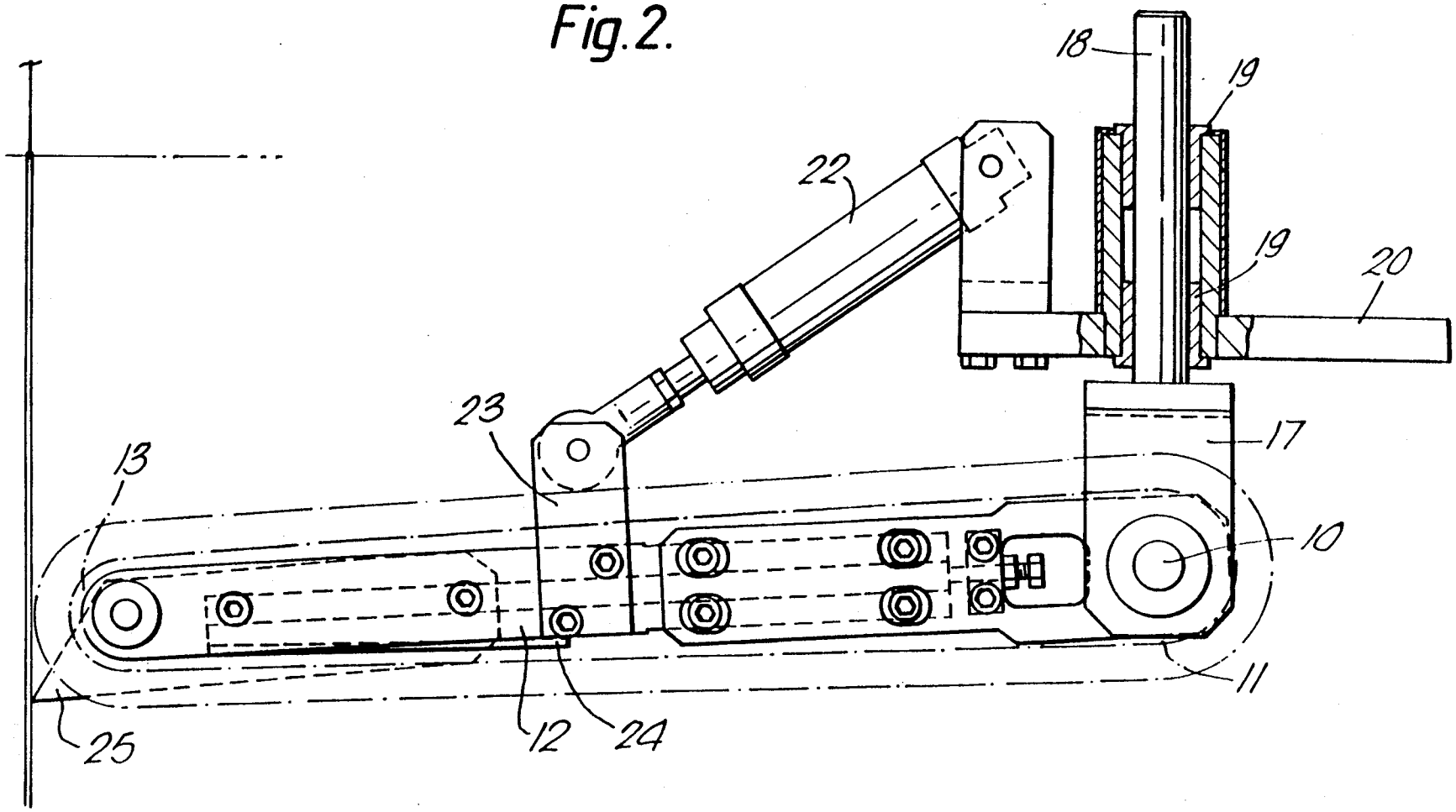
FIG. 2 is a side elevation of part of the top feeding track assembly.

A slicing machine includes a blade 1 having a spiral cutting edge 2 which, as the blade is rotated, moves along the plane of cut 3. The slicing machine includes a feeding device comprising a top feeding track assembly 4 and a lower feeding track assembly 5. The top feeding track assembly 4 consists of four separate tracks 6, 7, 8 and 9 having a ganged drive provided by a common axle 10 which drives driving sprocket wheels 11. Each top feeding track 6, 7, 8, 9 includes a frame 12 having an idler sprocket wheel 13 at its downstream end and is pivoted about the axle 10. The tracks 6, 7, 8, 9 are formed by a sprocket chain 14 having a K-attachment 15 on its inner links to which stepped plates 16 are connected. The axle 10 is rotatably journalled in a supporting yoke 17 which is mounted on slidable guide pins 18 which are journalled in bearings 19 mounted in movable carriage 20.

Figure 3:
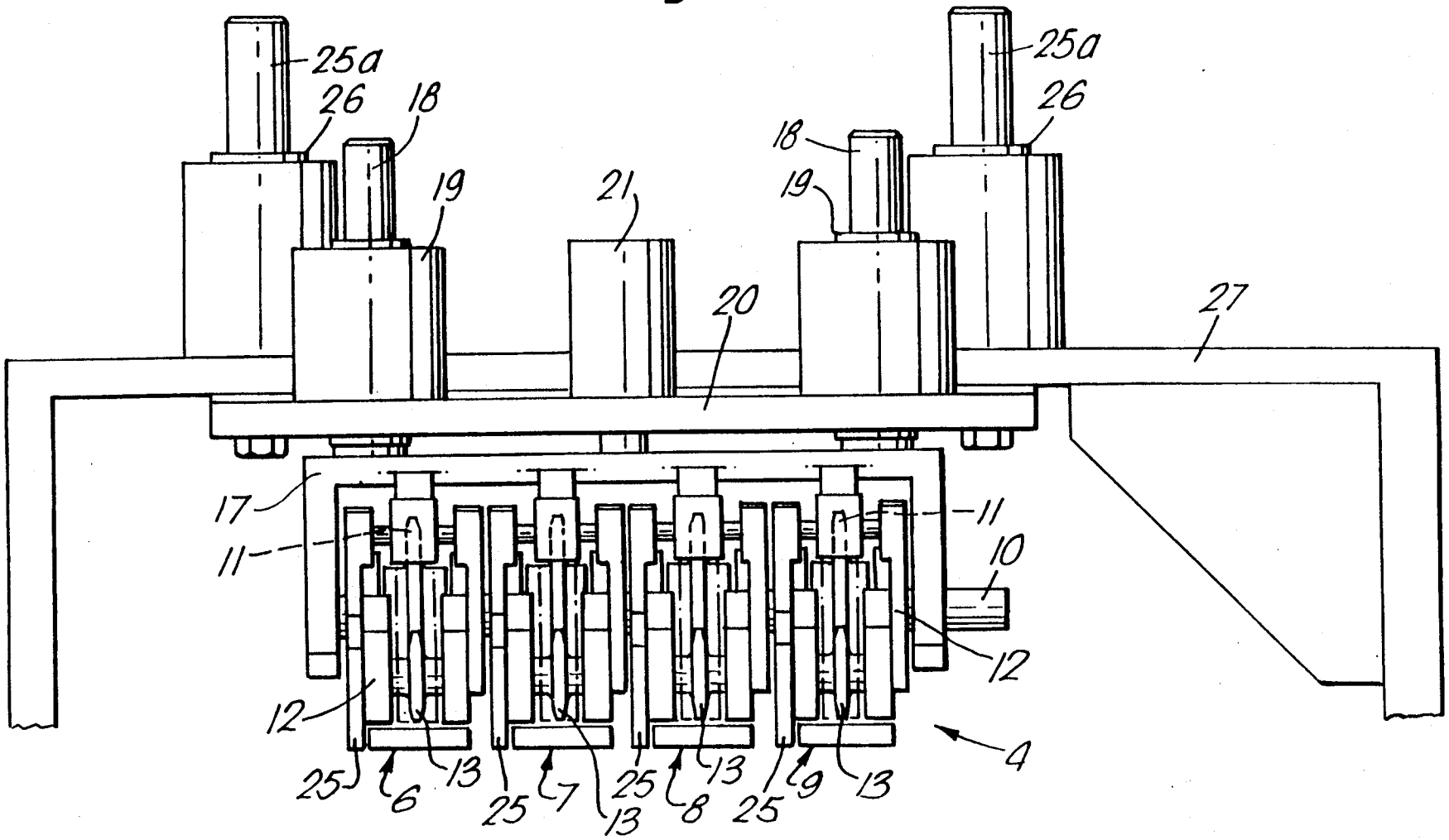
FIG. 3 is a front elevation of the top feeding track assembly with the tracks omitted.
Figure 4:
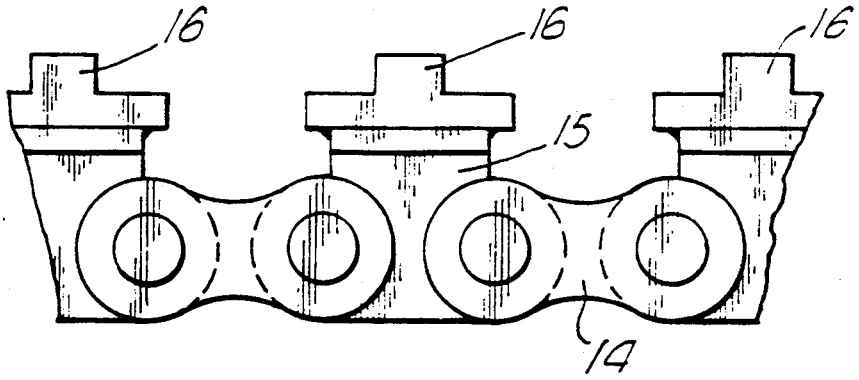
FIG. 4 is an enlarged side elevation of part of the feeding track.
Figure 5:
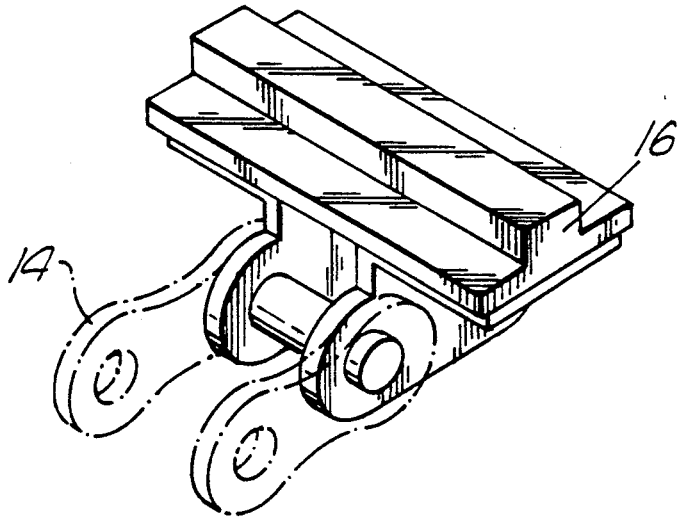
FIG. 5 is a perspective view of a pair of links of the feeding track.

A double acting pneumatic piston and cylinder assembly 21 is connected and acts between the supporting yoke 17 and the movable carriage 20 and, in use, is arranged to urge the yoke 17 and with it the upstream ends of the tracks 6, 7, 8, 9 downwards. Four further double acting pneumatic cylinder assemblies 22 (which have been omitted from FIG. 3 for clarity) are connected and act between the movable carriage 20 and saddles 23 attached to the frames 12. In use these urge the downstream ends of the frames 12 and hence the downstream ends of the tracks 6, 7, 8, 9 downwards. A support 24 made of Delrin (Registered Trade Mark) is connected to the frame 12 and provides support for the downstream portion of the tracks 6, 7, 8, 9. A finger 25 is connected to one side of each of the frames 12 and, in use, engages the surface of a block of product immediately adjacent the plane of cut 3 of the blade 1.

The movable carriage 20 includes guide pins 25*a* which are journalled in bearings 26 connected to a main frame 27 of the slicing machine and a hand wheel 28 and lead screw assembly 29 is arranged to raise and lower the movable carriage 20 with respect to the main frame 27 to provide a rough manual adjustment of the separation between the to and lower feeding track assemblies 4 and 5.

The lower feeding track assembly 5 comprises a pair of sprocket chains 30 with their bearing pins extending on their inner faces which support square sectioned rods 31. One end of each of the rods 31 is welded to an auxilliary link to prevent them rotating. Guides 32 support the sprocket chains 30 and hence support the product carried by them. The sprocket chains 30 extend between a pair of drive sprocket wheels 33 mounted on a common axle 34 and roller sprocket wheels 35. An elongate guide 36 extending transversely to the direction of movement of the feeding tracks 4 and 5 extends at a downstream end of the lower conveying track assembly 5 to provide support for the product up to the plane of cut 3 of the blade 1. The lower feeding track assembly 5 is mounted on bearings 37, 38 so that it can be moved bodily towards and away from the blade 1. This allows it to be withdrawn to enable access to be gained to the top feeding track assembly 4 for maintainance and cleaning.

Figure 9:
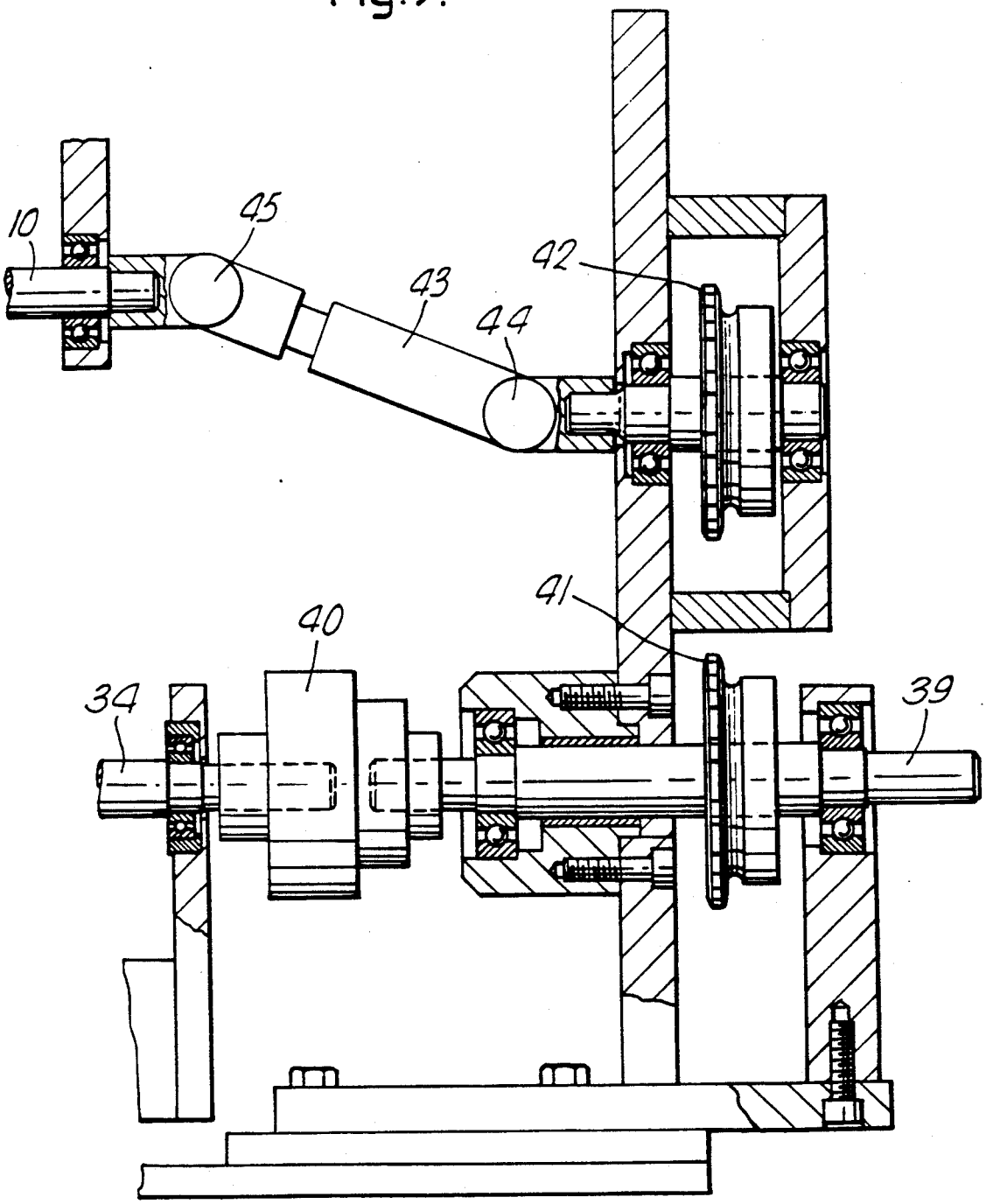
FIG. 9 is a rear elevation illustrating the drive to the upper and lower feeding tracks; and, FIG. 10 is a diagram illustrating how the upper tracks conform to the surface of the side of bacon.

FIG. 9 illustrates the drive assembly and shows that the drive is connected via an input shaft 39 and a releasable coupling 40 to the axle 34 of the lower feeding track assembly 5 and via a sprocket wheel 41 connected to the input shaft 39 and a reversing loop of sprocket chain (not shown) to a driven sprocket wheel 42. The driven sprocket wheel 42 is connected by an extendible link 43, a universal joint 44 and then via a second universal joint 45 to the driven axle 10 of the top feeding track assembly 4. The universal joints 44 and 45 and the extendible link 43 accommodate the vertical upwards and downwards movement of the axle 10.

Figure 10:
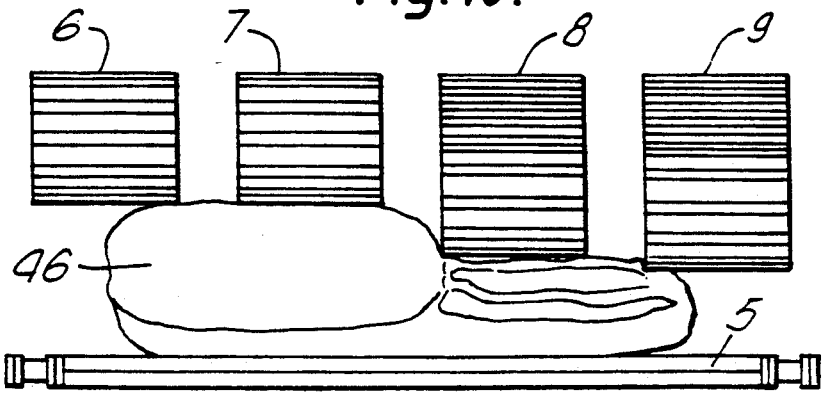
Figure 6:
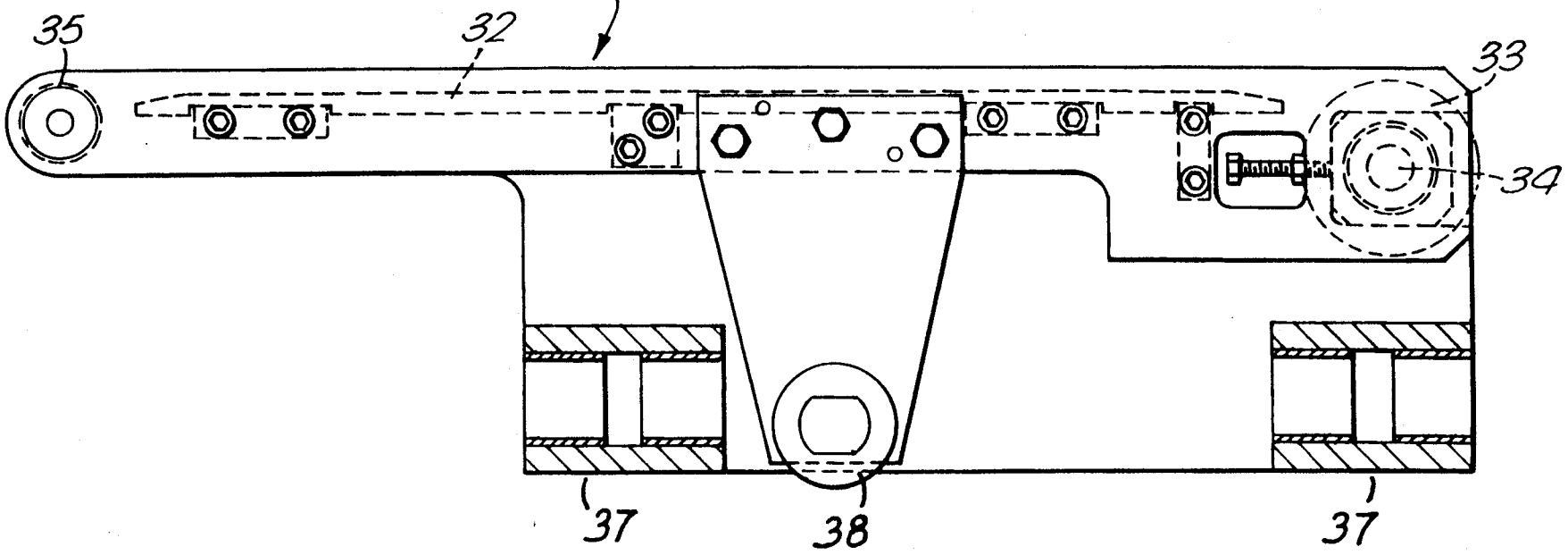
FIG. 6 is a side elevation of .the lower feeding track.
Figure 7:
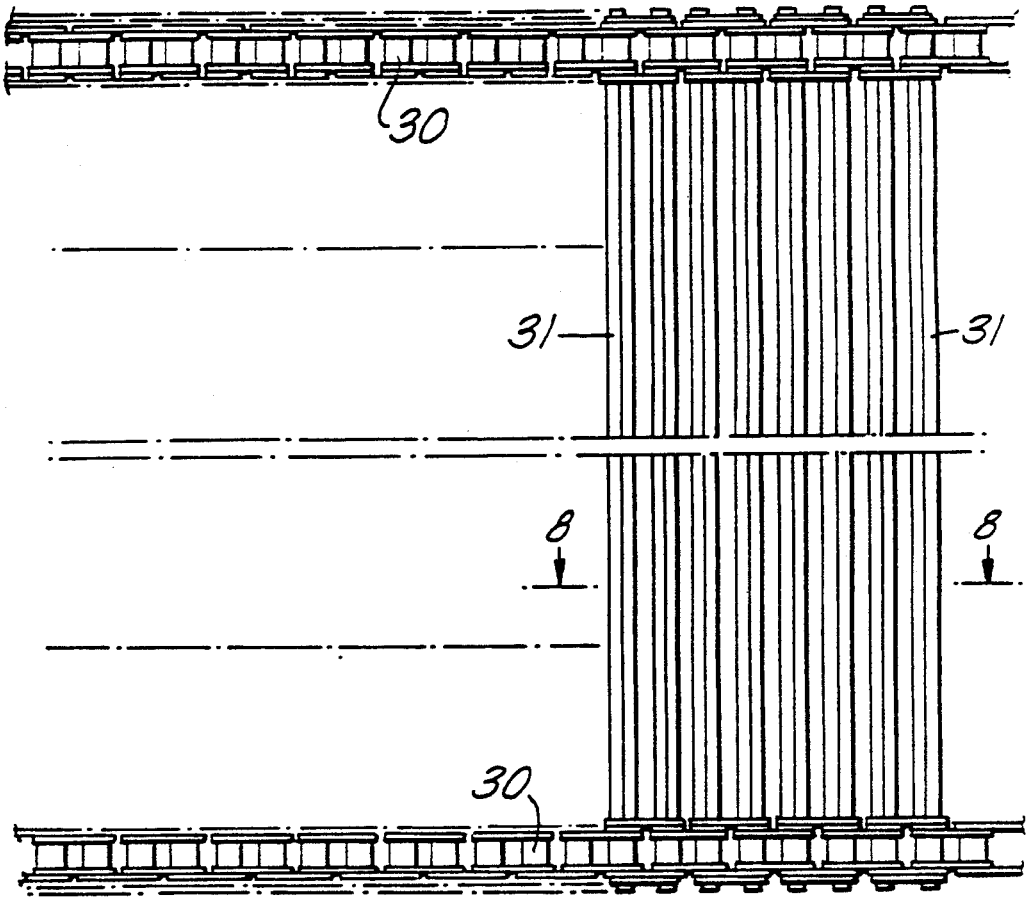
FIG. 7 is a plan of the lower feeding track.
Figure 8:
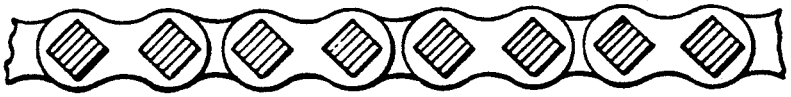
FIG. 8 is a cross section taken on the lines 8—8 shown in FIG. 7.

FIG. 10 illustrates diagrammatically how the individual conveying tracks 6, 7, 8 and 9 under the action of their pneumatic cylinder assemblies 22 are forced downwards to conform to the surface of an irregularly shaped block of meat such as a side of bacon 46.

I claim:

1. A slicing machine including a rotatable blade and a feeding device for feeding blocks of product towards said blade, said feeding device comprising:

opposed endless track assemblies having upstream and downstream ends;

drive means connected to said opposed endless track assemblies and arranged to drive adjacent faces of said opposed endless track assemblies in the same direction;

a common support;

one of said opposed endless track assemblies being formed by a plurality of separate longitudinally extending feeding tracks, said plurality of separate longitudinally extending feeding tracks being arranged side-by-side and being pivotally connected to said common support, said drive means providing a ganged drive for all of said plurality of separate longitudinally extending feeding tracks;

biasing means operatively connected to said plurality of separate longitudinally extending feeding tracks and arranged to urge downstream ends of said separate longitudinally extending feeding tracks independently towards the other opposed endless track assembly whereby, in use, said separate longitudinally extending feeding tracks pivot independently and hold a block of product the thickness of which is non-uniform in a direction transverse to said same direction in which said adjacent faces of said opposed endless track assemblies are driven;

mounting means slidably mounting said common support for movement in a direction parallel to a plane of rotation of said rotatably blade; and, pneumatic actuators operatively connected to said common support and arranged to urge said common support towards said other opposed endless track assembly and thereby, in use, accommodate differences in thickness between subsequent blocks of product without pivoting movement of said plurality of longitudinally extending feeding tracks.

2. A slicing machine according to claim 1, in which elongate guide fingers (25) are intercallated between the separate longitudinally extending feeding tracks (6, 7, 8, 9) and are arranged to engage and support the product immediately adjacent the blade (1) and so support the product right up to a downstream end of the feeding tracks.

3. A slicing machine according to claim 2, in which each finger is connected to a support for one of the separate longitudinally extending feeding tracks (6, 7, 8, 9) and moves towards and away from said opposed endless track assembly (5) with a respective one of the separate longitudinally extending feeding tracks (6, 7, 8, 9).

4. A slicing machine according to any of claims 2, 3, or 1, in which the separate longitudinally extending feeding tracks (6, 7, 8, 9) include a support (24) arranged towards said downstream end thereof to bear against the separate feeding tracks (6, 7, 8, 9) and urge them towards said opposed endless track assembly (5).

5. A slicing machine according to any of claims 2, 3, or 1, in which the separate feeding tracks (6, 7, 8, 9) comprise sprocket chains (14) having transverse plates (16) attached to adjacent links.

6. A slicing machine according to claim 5, in which the transverse plates (16) have a stepped surface to engage the block of product (46).

7. A slicing machine according to any of claims 2, 3, or 1, in which the biasing means are a number of pneumatic actuators (22) arranged and acting between the support (20) and the downstream end of the separate feeding tracks (6, 7, 8, 9).

* * * * *